United States Patent [19]

Hildebrandt et al.

[11] 4,106,462

[45] Aug. 15, 1978

[54] IGNITION SYSTEM CONTROL CIRCUIT

[75] Inventors: Herbert J. Hildebrandt, Baldwinsville; Donald W. Perkins, De Witt, both of N.Y.

[73] Assignee: General Electric Company, Syracuse, N.Y.

[21] Appl. No.: 668,052

[22] Filed: Mar. 18, 1976

[51] Int. Cl.[2] ..... F02P 3/04

[52] U.S. Cl. ..... 123/148 E; 123/146.5 A; 315/209 T

[58] Field of Search ..... 123/117 R, 146.5 A, 123/148 E; 315/209 R, 209 T

[56] References Cited

U.S. PATENT DOCUMENTS

| | | | |
|---|---|---|---|
| 3,822,684 | 7/1974 | Salway | 123/148 E |
| 3,875,920 | 4/1975 | Williams | 123/148 E |
| 3,931,804 | 1/1976 | Bowen | 123/148 E |
| 3,937,193 | 2/1976 | Kim | 123/148 E |
| 3,938,490 | 2/1976 | Snyder et al. | 123/148 E |

OTHER PUBLICATIONS

Jerome E. Oleksy, "Practical Solid-State Design", May 1974, p. 35.

*Primary Examiner*—Charles J. Myhre

*Assistant Examiner*—Andrew M. Dolinar

*Attorney, Agent, or Firm*—Carl W. Baker; Richard V. Lang; Frank L. Neuhauser

[57] ABSTRACT

The invention discloses an ignition system control circuit which may be mounted within a distributor housing such as is used with internal combustion engines. The ignition system control circuit is coupled to a direct current source and appropriately connected to the primary winding of the high voltage generating coil of the ignition system. Current through the primary of the high voltage generating coil is controlled by a Darlington power amplifier, the conduction and non-conduction of which is appropriately synchronized to the engine. The control circuit includes a constant current source connected to a biasing resistor network of the Darlington power amplifier, and the constant current source supplies the Darlington power amplifier with a value of current to assure saturation of the Darlington power amplifier to allow maximum current to flow through the primary winding of the ignition coil notwithstanding substantial variations in voltage of the direct current source. The ignition system control circuit further includes a feedback loop to provide increased gain during switching.

5 Claims, 4 Drawing Figures

IGNITION SYSTEM CONTROL CIRCUIT

BACKGROUND OF THE INVENTION

1. Field of the Invention

This invention relates to a new and improved control circuit for ignition systems for internal combustion engines and more particularly to transistorized ignition systems for internal combustion engines.

2. Description of Prior Art

The conventional internal combustion engine utilizes an ignition system which includes an ignition coil, or high voltage generating coil, having primary and secondary windings, the secondary winding of which is electrically coupled to spark discharge devices, such as spark plugs, or ignitors, in a predetermined sequence by a high voltage distributor which is synchronized with the crankshaft angle of the engine. The primary winding of the ignition coil is coupled to a source of voltage through a switch known as the distributor points, or more commonly referred to as points, across which is connected a capacitor. The opening and closing of the points is likewise synchronized with the engine. Ideally, the operation of this system is such that the primary winding of the ignition coil has current flow therethrough which current flow is interrupted by the points at substantially the same time that the high voltage distributor is in a position to efficiently transfer a resulting high voltage appearing in the secondary winding of the ignition coil to one of a plurality of spark plugs.

Although highly developed, the distributor points, when used directly with a high voltage generating coil, have well known disadvantages that make undesirable the use of such points in the ignition systems for internal combustion engines. For example, one disadvantage is that the distributor points are subject to continuous erosion that necessitates their frequent replacement. Also, at high engine speeds, the points tend to float or bounce due to inertia, thereby making development of the secondary winding high voltage undependable. Further, the time at which a spark takes place at the spark plug when using points in the ignition circuit may vary as a result of such factors as changes in engine speed, spring force between the points, the pitted condition of the points, friction, vibration and the like.

With the advent of reliable semiconductor components, electronic ignition control circuits have been made available to reduce deterioration of point contacts, to increase the spark plug life, to allow firing of fouled spark plugs, to eliminate high speed misses, and to provide easier starting as well as to provide other advantages.

Nevertheless, prior art ignition systems including magnetic and optical-transistor control switching circuits for triggering a charge of electricity to the spark plug have generally not worked as well as anticipated due to the difficulty of achieving a reliable switching means to trigger the high voltage ignition coil. One of the most serious problems in the prior art revolves around the circuit used to control the electronic switching in the primary of the high voltage generating coil.

It has been conventional to mount such electronic control circuits in the engine compartment wherein the circuits become vulnerable to the heat associated with the engine. Consequently, the highly temperature sensitive transistor circuits do not always insure the desired switching reliability.

Moreover, poor battery conditions or cold weather affect the amount of voltage available for starting the engine. Thus, it is desirable to provide a circuit that will be operable over a wide range of battery voltage.

Accordingly, it is an object of this invention to provide an improved control circuit for an ignition system which control circuit is least affected by variations in the voltage supplied by the vehicle electrical system.

It is another object of the invention to provide an improved ignition system which will operate over a large range of temperature extremes.

It is still another object of this invention to provide an improved ignition system which provides better noise immunity and faster overall switching characteristics than existing ignition systems.

It is a further object of this invention to provide maximum voltage across the distributor coil under varying operating conditions.

Other objects and advantages of the invention will be obvious to those skilled in the art when reference is had to the text hereof.

SUMMARY OF THE INVENTION

The control circuit of this invention includes a transistor switching amplifier, preferably in the form of a Darlington power amplifier, the conduction and non-conduction of which is appropriately synchronized to the crankshaft angle or position of an internal combustion engine, for controlling current through the primary of a high voltage generating coil of an ignition system for the engine. A constant current source is connected to a biasing network for the Darlington power amplifier whereby the constant current source supplies to the Darlington power amplifier a predetermined value of bias current to assure saturation of the Darlington power amplifier and allow maximum current to flow therethrough at appropriate time intervals. Since the Darlington power amplifier is connected in series with the primary winding of the high voltage generating coil of the ignition system, maximum current also flows through the primary winding of the ignition coil. When the Darlington switches from the conductive to the non-conductive state, high voltage is developed across the secondary winding of the high voltage generating coil. This voltage is then transferred by the engine's distributor to one of a plurality of spark plugs.

A positive feedback loop provides increased gain at the input of the control circuit during switching to give a trigger type of operation so as to assure reliable circuit operation over a large range of source of supply voltage and temperature extremes.

DETAILED DESCRIPTION OF ONE EMBODIMENT

Figure 1:
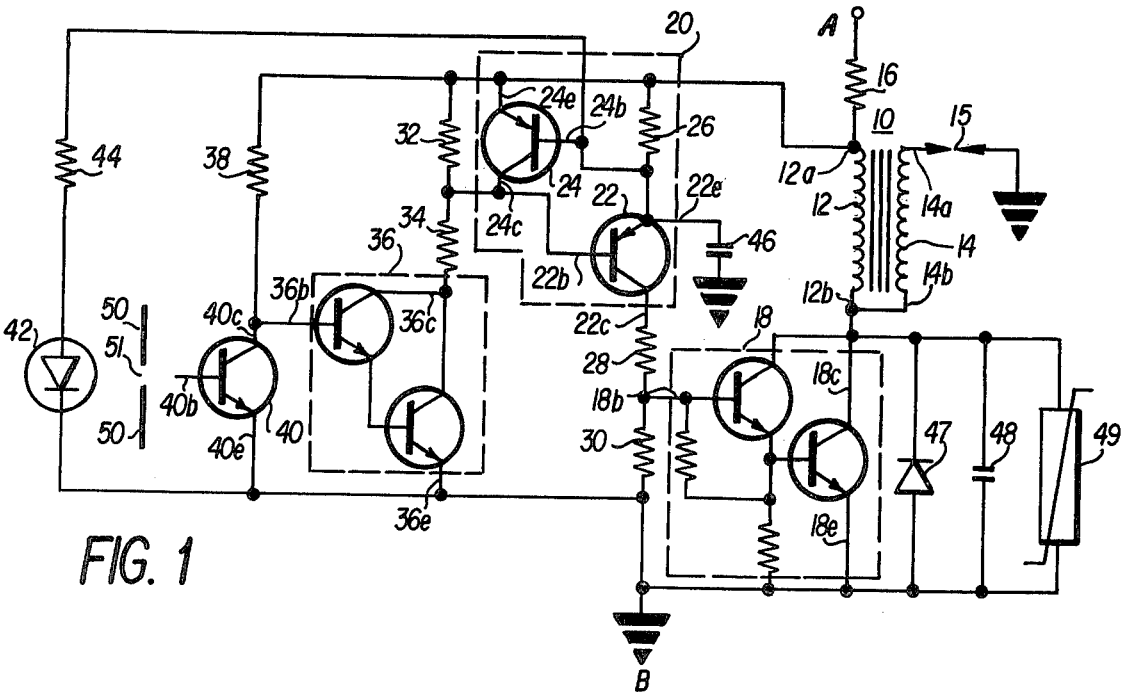
FIG. 1 is a circuit diagram of the interconnected electronic components of the control circuit of the invention.

Referring to the drawings and more particuarly to FIG. 1 thereof, there is shown a high voltage generating coil 10 having a primary winding 12 and a secondary winding 14. A first end lead 14*a* of secondary winding 14 provides the high voltage output which is coupled to the distributor of the internal combustion engine, not shown for clarity. Illustratively, a gap 15 is shown as representative of a single spark plug. One end or terminal 12*a* of primary winding 12 is connected to a first terminal A of a power source through a resistor 16. A second end or terminal 12*b* of winding 12 is connected to the second end lead 14*b* of secondary winding 14 and to a second terminal B or ground of the same power source through a switch formed by the collector terminal 18*c* and the emitter terminal 18*e* of a transistor switching amplifier which in the preferred embodiment illustrated takes the form of a Darlington amplifier 18 also referred to herein as a Darlington power amplifier. Diode 47, capacitor 48, and surge suppressor 49, each in parallel with one another, are connected to the collector terminal 18*c* of Darlington power amplifier 18 and to terminal B of the power source. Capacitor 48 develops a voltage thereacross when Darlington power amplifier 18 switches off, i.e., becomes non-conductive. Surge suppressor 49 limits the maximum voltage of one polarity developed across capacitor 48 and diode 47 clamps the maximum voltage of the reverse polarity developed across capacitor 48 as will be more apparent from the further description herein. Darlington power amplifier 18 is provided with proper bias at base 18*b*, at appropriate times, by a constant current generator 20 to permit the same to perform the switching function somewhat similar to that performed by the "points" in a conventional internal combustion engine ignition system.

Constant current generator 20 comprises a first transistor 22 and a second transistor 24. Transistor 22 comprises an emitter 22*e*, a base 22*b* and a collector 22*c*. Transistor 24 likewise comprises an emitter 24*e*, a base 24*b* and a collector 24*c*. For purposes of providing bias to Darlington power amplifier 18, the emitter 22*e* of transistor 22 is connected through a resistor 26 to the first end terminal 12*a* of primary winding 12. The collector 22*c* of transistor 22 is connected to the second terminal B of the power source through a resistor 28 in series with a resistor 30. The common connection between resistor 28 and resistor 30 is connected to the base or control element 18*b* of Darlington power amplifier 18. Resistor 26 is shunted by the emitter-base 24*e*, 24*b* of transistor 24 with base 24*b* being in common connection with emitter 22*e* and one side of resistor 26 and emitter 24*e* being connected to the common connection of resistor 26 and the first terminal of primary winding 12. Base 22*b* and collector 24*c* are connected together. Bias to base 22*b* of transistor 22 is supplied through a voltage divider network including a resistor 32 and a resistor 34 in series with a second Darlington amplifier 36 and through the collector 36*c* and emitter 36*e* of said Darlington amplifier to terminal B. Bias to second Darlington amplifier 36 is applied to the base 36*b* through a resistor 38 connected to said base and to the first end terminal 12*a* of primary winding 12.

The base emitter circuit of second Darlington amplifier 36*b* is shunted by a radiation detector 40 which is provided with a base 40*b*, an emitter 40*e* and collector 40*c*. Radiation detector 40, which may advantageously be a light sensitive detector, is cooperatively coupled to radiation source 42. Power to radiation source 42, which may advantageously be a light emitting diode, is effected at one terminal 42*a* through a resistor 44 which in turn is connected to the common terminal for emitter 22*e* and base 24*b*. This provides a positive feedback loop which, as hereinafter more fully explained, acts to regeneratively modulate the radiation from radiation source 42 so as to cause each switching action, once initiated, to go to completion more rapidly and more positively. Second terminal 42*b* of the radiation source is connected to the second terminal B of the power source. A rotary shutter element 50, having a number of apertures 51, is interposed between radiation detector 40 and radiation source 42 for interrupting transmission of radiation therebetween at appropriate time intervals. Element 50 is mounted to the distributor shaft as shown in FIG. 4 and thereby rotates in synchronism with the crank shaft position during engine operation.

A capacitor 46 is connected at one end to emitter 22*e* and at the other end to terminal B to aid in the elimination of undesirable transients. Alternatively, the capacitor could be connected to collector 22*c* and to terminal B.

Figure 4:
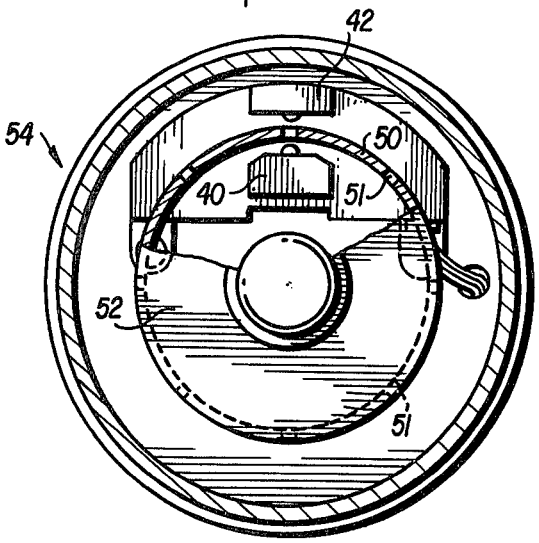
FIG. 4 is a sectional view through the distributor head along lines 4—4.
Figure 3:
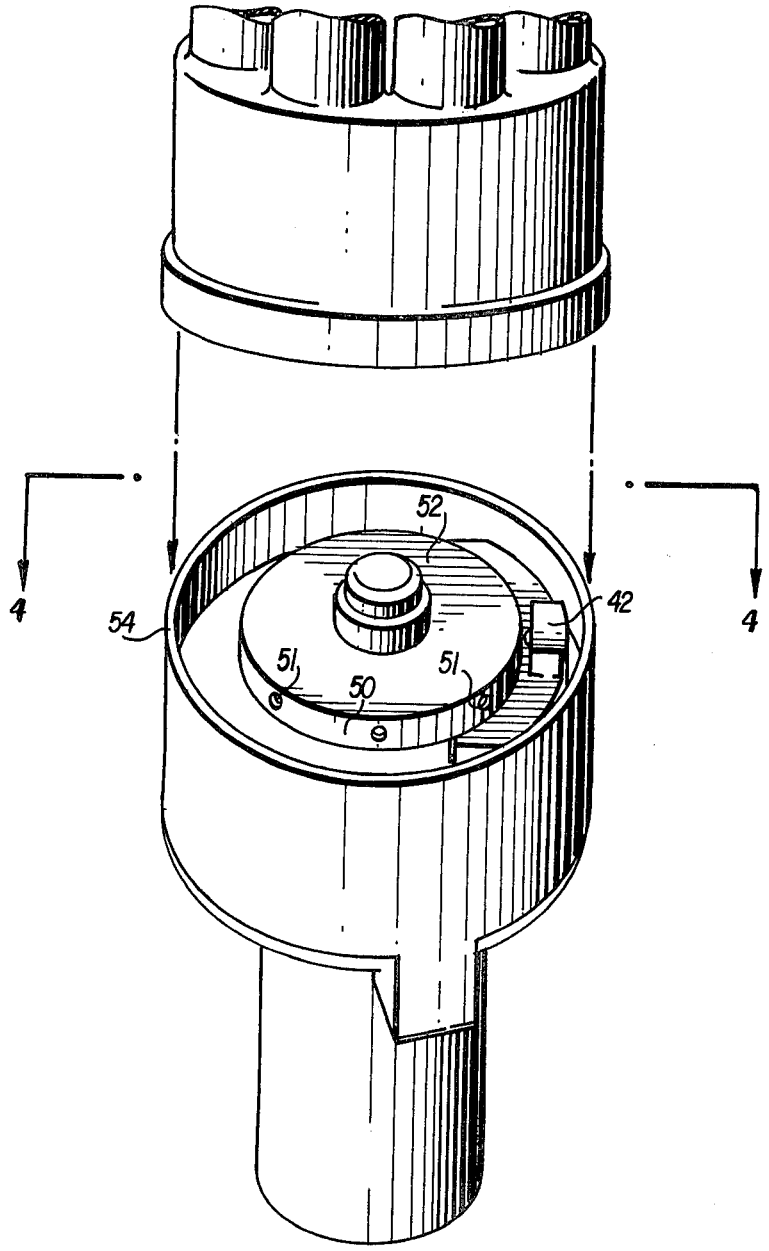
FIG. 3 is a fragmented perspective view of the distributor head showing the ignition control circuit mounted therein.

FIGS. 3 and 4 show element 50 in relationship to the electronic control circuitry of the invention disposed in a case 52 of distributor housing 54.

Illustrative components for the circuit of FIG. 1 are:

10 Coil; 10 mhy
16 Resistor; 1.35 ohm
18 Darlington; custom, similar to IR4045 (IRC)
22 Transistor D43Cl (GE)
24 Transistor; GET 2907 (GE)
26 Resistor; 2.4 ohms
28 Resistor; 8 ohms
30 Resistor; 33 ohms
32 Resistor; 680 ohms
34 Resistor; 220 ohms
36 Darlington; GET 5306 (GE)
38 Resistor; 22K ohms
40 Phototransistor; L14G1 (GE)
42 Light Emitting Diode; LED 55 B (GE)
44 Resistor; 220 ohms
46 Capacitor; 1 mfd
47 Diode; 10D8 (IRC)
48 Capacitor; 0.2 mfd
49 Varistor; V130LAX727 (GE)

Figure 2:
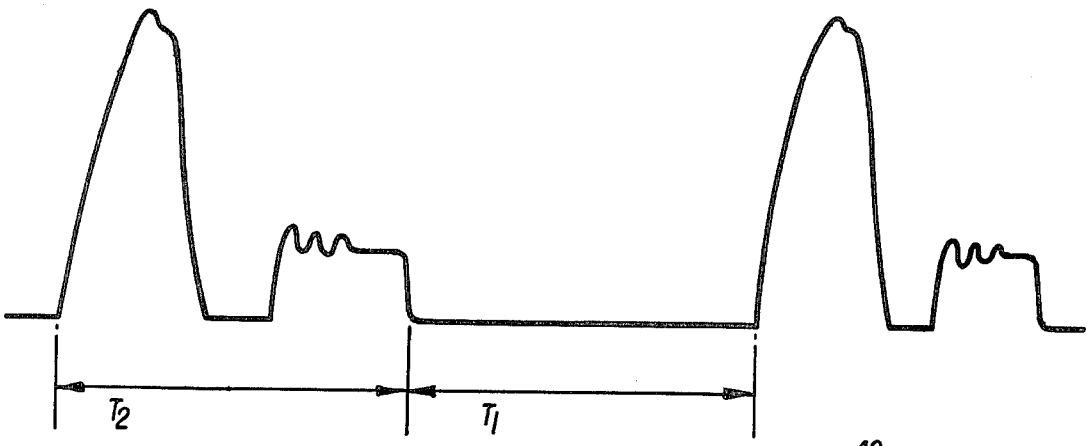
FIG. 2 is a graph of voltage against time illustrative of the wave shapes at the collector of the Darlington power amplifier in the circuit of FIG. 1.

The operation of the control circuit of FIG. 1 may best be understood by considering the same under two input conditions. Under a first condition, the element 50 interposed between radiation source 42 and radiation detector 40 inhibits the energy from radiation source 42 reaching the radiation detector 40. The foregoing first condition occurs during the time period T1, as shown in FIG. 2. Under a second condition, the element 50 interposed between radiation source 42 and radiation detector 40 permits the energy from radiation source 42 to reach radiation detector 40. The second condition occurs during the time period T2.

Under the first condition, interruption of the radiation between the source 42 and detector 40 causes the detector 40 to be non-conductive except for inherent low current leakage. With the non-conductivity of detector 40, the bias at base 36*b* of second Darlington amplifier 36 is raised to a value causing said second Darlington amplifier 36 to become conductive. With second Darlington amplifier 36 conductive, a current flows between power source terminal A through resistor 16, resistors 32 and 34, collector 36c and emitter 36e to power terminal B. At the same time, current flows from power source terminal A through resistor 16 and emitter 24e — collector 24c of transistor 24, to the junction of resistors 32 and 34. A current also flows at the same time from power source A through resistor 16, resistor 26 and emitter 22e and base 22b of transistor 22 to the junction of resistors 32 and 34. The foregoing currents through transistors 22 and 24 merging at the common terminal of resistors 32 and 34 provide a bias to the base 22b of transistor 22 and flow through resistor 34 and the collector 36c — emitter 36e of second Darlington amplifier to power terminal B.

Under the foregoing conditions, the emitter 22e — base 22b current of transistor 22 is amplified at collector 22c to provide the base drive bias current through resistor 28 to base 18b of first Darlington power amplifier 18 of a magnitude to cause first Darlington power amplifier 18 to operate in a saturated state.

With first Darlington power amplifier 18 in a saturated state, current flows from power source terminal A through resistor 16 and the high voltage generating coil primary 12 of coil 10 through collector 18c and emitter 18e of Darlington power amplifier 18 to power source terminal B.

It is necessary that Darlington power amplifier 18 operate in a saturated state under the first condition in order that the maximum desirable current consistent with circuit parameters be flowing in the primary 12 of coil 10 prior to Darlington power amplifier 18 becoming non-conductive since the ability to arc the spark gap of the spark plugs with which the high voltage generating coil 10 is to operate depends upon the amount of current in the primary 12 of coil 10 prior to the circuit "break" which is effected by Darlington power amplifier 18 being switched off.

To assure that Darlington power amplifier 18 is in a saturated state during the first condition, the collector 22e current of transistor 22 flowing through resistor 28 to the base 18b of Darlington power amplifier 18 must be maintained at a predetermined value that ensures saturation of the Darlington power amplifier 18.

Transistors 22 and 24, by virtue of their disposition in the circuit of FIG. 1, function as a constant current generator for maintaining the predetermined value of current through resistor 28.

It will be noted that resistor 26 is in series with the emitter circuit of transistor 22 and simultaneously is in parallel with the emitter — base circuit of transistor 24. Further, it will be noted that the emitter 22e current of transistor 22 flowing through resistor 26 is approximately equal to the collector current 22e current of transistor 22 since the base 22b current is negligibly small. Thus, by maintaining emitter 22e current through resistor 26 at the predetermined value, the collector 22c current is also maintained for assuring the saturation of Darlington power amplifier 18.

The constant current generator 20 functions as follows. Should the emitter 22e current through resistor 26 start to rise due to an increase in voltage of the power source, the voltage across resistor 26 tends to increase, thereby changing the emitter 24e – base 24b voltage on transistor 24 to increase conductivity. The increased conductivity of transistor 24 is accompanied by a simultaneous increase in the emitter 24e current through transistor 24 and a simultaneous corresponding decrease in the base 22b current through transistor 22. The shunting effect created by the increased conductivity of transistor 24 continues until the level of emitter 22e current flowing through resistor 26 returns to substantially the predetermined value of current which causes Darlington power amplifier 18 to operate in a saturated state.

Under the first condition, it will be seen that no high voltage appears at the secondary 14 of high voltage generating coil 10 since the current through the primary 12 of coil 10 and the collector — emitter circuit of Darlington power amplifier is direct current.

Under the second condition and at the appropriate time for developing a high voltage across the secondary of high voltage generating coil 10, as dictated by the engine crankshaft angle, energy from radiation source 42 is permitted to reach detector 40, through an aperture 51 of element 50. Detector 40 becomes conductive and the base bias for Darlington amplifier 36 is reduced to a value to thereby render Darlington power amplifier 18 non-conductive.

With Darlington power amplifier 18 switching to a non-conductive state, the current flowing through primary winding 12 of coil 10 charges capacitor 48 to a maximum predetermined voltage regulated by surge suppressor 49 which is in parallel with capacitor 48. Surge suppressor 49 preferably clamps the accumulated charge or voltage across capacitor 48 to approximately 400 volts, illustratively. Once 400 volts is obtained across capacitor 48, current flows from the capacitor 48 to terminal 14b of secondary winding 14 through secondary winding 14, adding to the developed induced secondary energy of coil 10 and causing current to arc across the gap 15 of the spark plug and flow to ground or power terminal B.

The voltage across capacitor 48 and the voltage developed across the primary 12 of coil 10 due to the current flow therethrough at the time Darlington power amplifier 18 becomes non-conductive generates, illustratively, approximately 30 kilovolts in the secondary winding 14 of coil 10. This 30 kilovolts is transferred by the distributor to one of a plurality of spark plugs for firing the engine.

As capacitor 48 discharges through secondary winding 14 and this discharge current is added to that in secondary 14, the current flowing through primary winding 12 is decreasing because of the energy stored in coil 10, which is expressed by the equation $E = \frac{1}{2} LI^2$, being removed from primary winding 12 as the gap 15 of the spark plug is bridged.

Once the voltage across capacitor 48 starts to decrease, the current in primary winding 12 commences to flow in a reversed direction charging capacitor 48 in an opposite direction. The capacitor 48 charges sufficiently to bias diode 47 to cause it to become conductive, clamping the reverse polarity voltage across capacitor 48.

Referring to FIG. 2, it will be seen that with the commencement of the reverse flow of current during period T2 the voltage applied to the collector-emitter of Darlington power amplifier 18, which is in parallel with capacitor 48, goes negative. Since diode 47 is now conductive, the voltage applied across the collector-emitter of Darlington power amplifier 18 is clipped, illustratively, to approximately -0.7 volt.

After the expiration of approximately 100 microsecond, which is the middle portion of the period T2 in FIG. 2, assuming the specified exemplary circuit component values, the current flowing in primary winding 12 of coil 10 goes to zero, whereupon primary winding 12 changes polarity again and current commences to flow in the reversed direction, charging capacitor 48 to a positive polarity. The voltage applied across the collector-emitter of Darlington power amplifier 18 thus goes positive again, but the amplitude of the voltage is lower than that of the previous cycle due to energy being removed in the previous cycle. Further, oscillations during the one cycle of operation are lower in amplitude than previous oscillations due to energy being removed every cycle and the overall damping in the circuit. Because the high voltage developed across the spark gap by the secondary winding 14 of coil 10 decays, the decaying high voltage is not able to sustain the arc generated across the gap 15 and the collector-emitter voltage of Darlington power amplifier 18 settles to that voltage supplied by the power source, as illustrated in FIG. 2.

As seen in FIG. 2, at the end of time period T2, Darlington power amplifier 18 becomes conductive due to the interruption of radiation from radiation source 42 to radiation detector 40 and returns to a saturated state, at which time the circuit is again operative under the first condition as previously described.

The circuit of FIG. 1 is provided with a positive feedback loop, including radiation source 42, and resistor 44, which functions with transistors 22 and 24 and resistor 26 to improve the response time of the circuit by providing an increase in voltage across radiation source 42 at the proper time to facilitate a quicker switching off of Darlington power amplifier 18. A similar improvement in operation is achieved when amplifier 18 returns to its conductive state.

When radiation from radiation source 42 is transmitted through an aperture 51 to radiation detector 40, the voltage drop across resistor 26 decreases due to the small magnitude of current passing through this resistor when transistor 22 is switched off, thereby increasing the voltage across radiation source 42. As the voltage across radiation detector 40 rises, the radiation emitted by radiation source 42 correspondingly increases. This increase in radiation increases the reliability of response of the control circuit at appropriate times.

Finally, in addition to faster overall switching characteristics, the capacitor 46 provides for better noise immunity.

The nature of the control circuit as hereinabove described permits the same to be mounted on a single ceramic base which may be mounted in an enclosure therefor, with the ensuing package lending itself to mounting within the distributor housing of an internal combustion engine.

While a particular ignition control circuit has been shown and described, other modifications, will occur to those skilled in the art. It is intended, therefore, that the invention not be limited to the particular embodiment shown and described and that the appended claims should cover such modifications as fall within the spirit and scope thereof.

What is claimed as new and desired to be secured by Letters Patent of the United States is:

1. An ignition control circuit for providing the supply current switching function for the high voltage generating coil in an internal combustion engine ignition system including such coil and a power supply therefor, said ignition control circuit comprising:

(a) means for developing a control input signal representative of the crankshaft angle of the internal combustion engine with which said ignition control circuit is to function;

(b) an input transistor switching amplifier having said control input signal applied thereto and being responsive to such signal to switch its conductivity state;

(c) an output transistor switching amplifier connected to complete a circuit between said high voltage generating coil and said power supply when conducting and to break such circuit when not conducting, said output amplifier including a control electrode to which an applied bias current is effective to control the completion of said circuit and the magnitude of current flow therein in accordance with the bias current;

(d) a constant current source including a current regulating circuit providing current output at a constant level;

(e) means connecting said input transistor switching amplifier to said current source for turning the current source on and off in accordance with the conductivity state of the input amplifier; and (f) means connecting said current source to the control electrode of said output transistor switching amplifier control to apply the constant current output of said source to said electrode as the operating bias for said output switching amplifier thereby to control current flow to said high voltage generating coil from said power supply.

2. The ignition coil circuit as defined in claim 1, wherein said means for developing a signal representative of the crankshaft angle of the internal combustion engine comprises a radiation source coupled to a complementary detector and having means for receiving a member therebetween, said member providing means for synchronizing the operation of said control circuit with the speed of the engine.

3. The ignition control circuit as defined in claim 2, including positive feedback loop means for increasing the radiation output of said radiation source to thereby enhance the response time of the output of said input transistor switching amplifier responsive to the developed input signal.

4. The ignition control circuit as defined in claim 1, wherein said output transistor switching amplifier is a Darlington power amplifier and wherein said constant current source supplies said Darlington power amplifier with bias current such as to assure saturation of the amplifier when switched on.

5. The ignition control circuit as defined in claim 4, wherein said constant current source comprises first and second transistors, with the emitter of said first transistor being connected through a load resistor to a first terminal of said power supply and the collector of said first transistor being connected through a biasing network for said Darlington power amplifier to a second terminal of said power supply, and with the emitter-base circuit of said second transistor being shunted by said load resistor whereby the base of said second transistor is in common connection with the emitter of said first transistor and one side of said load resistor, and the emitter of said second transistor is in common connection with the other side of said load resistor and said first power supply terminal, and the collector of said second transistor is connected to the base of said first transistor and its biasing source and to said input transistor switching amplifier.

* * * * *